United States Patent [19]

Haugen et al.

[11] 4,089,791

[45] May 16, 1978

[54] LUBRICATING OIL COMPOSITION

[75] Inventors: Haakon Haugen, Oslo, Norway; David G. Weetman, Hopewell Junction, N.Y.

[73] Assignee: Texaco Inc., New York, N.Y.

[21] Appl. No.: 638,585

[22] Filed: Dec. 8, 1975

Related U.S. Application Data

[63] Continuation-in-part of Ser. No. 470,688, May 16, 1974, abandoned.

[51] Int. Cl.[2] ..... C10M 1/26; C10M 1/48

[52] U.S. Cl. ..... 252/32.7 E; 252/33.4; 252/51.5 R

[58] Field of Search ..... 252/32.7 E, 33.4, 51.5 R

[56] References Cited

U.S. PATENT DOCUMENTS

| | | | |
|---|---|---|---|
| 2,839,469 | 6/1958 | Pfeifer et al. | 252/32.7 E |
| 3,290,347 | 12/1966 | Miller | 252/32.7 E X |
| 3,347,799 | 10/1967 | Meinhardt | 252/32.5 |
| 3,562,159 | 2/1971 | Mastin | 252/32.7 E |
| 3,711,406 | 1/1973 | Lowe | 252/33.4 |
| 3,779,920 | 12/1973 | Devries | 252/33.4 |
| 3,923,669 | 12/1975 | Newingham et al. | 252/32.7 E |
| 3,925,213 | 12/1975 | Froeschmann et al. | 252/32.7 E X |
| 3,933,659 | 1/1976 | Lyle et al. | 252/51.5 R X |
| 3,944,495 | 3/1976 | Wiley et al. | 252/32.7 E X |

*Primary Examiner*—Daniel E. Wyman
*Assistant Examiner*—Thomas A. Waltz
*Attorney, Agent, or Firm*—Thomas H. Whaley; Carl G. Ries; James J. O'Loughlin

[57] ABSTRACT

Lubricating oil composition comprising a major portion of a mineral lubricating oil and minor amounts of an overbased alkaline earth metal compound, of a trialkanolamine represented by the formula:

in which R is a hydrocarbyl radical having from 1 to 24 carbon atoms, R', Y and Z represent hydrogen or a hydrocarbyl radical having from 1 to 10 carbon atoms, and $x$ is 0 to 1, and of a zinc dihydrocarbyl dithiophosphate in which at least 50 percent of the hydrocarbyl radicals are alkaryl radicals.

2 Claims, No Drawings

LUBRICATING OIL COMPOSITION

This application is a continuation-in-part of application Ser. No. 470,688, filed 05/16/74, and now abandoned.

BACKGROUND OF THE INVENTION

1. Field of the Invention

This invention pertains to a low ash mineral lubricating oil composition intended for use as a motor oil in an internal combusion engine. Internal combustion engines employed in short driving trips involving cold engine operation are subject to extensive rusting of the engine parts. This type of service does not permit adequate engine warm-up which is necessary to remove the moisture which has condensed in the engine. To overcome this serious rusting tendency, a lubricating oil composition has previously been developed containing a highly effective rust inhibitor when employed in a low ash mineral lubricating oil composition. The rust inhibitor, generically described as a hydrocarbyl-substituted trialkanolamine, permits the formulation of a motor oil composition which will pass the required MS IIC Rust Test.

While the foregoing lubricating oil composition substantially overcame the rust problem associated with cold engine operation, this lubricant was deficient with respect to weight losses of connecting rod bearings as determined by the CLR L-38 Test. The additive combination which exhibited the outstanding rust inhibiting properties was identified as the causative agent leading to the serious bearing weight losses.

It has now been discovered that the noted low ash, rust inhibited lubricating oil composition can be modified to substantially reduce the engine bearing weight losses while retaining the desirable low ash, rust inhibiting properties.

2. DESCRIPTION OF THE PRIOR ART

U.S. Pat. No. 1,888,023 discloses a color-stabilized lubricating oil composition containing a primary, secondary or tertiary aliphatic amine or hydroxyalkylamine.

U.S. Pat. No. 2,353,830 discloses a lubricant for an air pump containing triethanolamine stearate and comprising 80 percent of water.

U.S. Pat. No. 3,458,444 discloses a rust inhibited mineral lubricating oil composition containing the reaction product of an alkenylsuccinic acid or anhydride and an N-hydrocarbyl diethanolamine.

A copending application Ser. No. 424,978 filed on Dec. 14, 1973 now abandoned discloses a low ash lubricating oil composition containing a hydrocarbyl substituted trialkanolamine which qualifies the lubricant in the MS-IIC Engine Rust Test. This disclosure is being relied upon and incorporated in this invention.

SUMMARY OF THE INVENTION

This invention pertains to a low-ash, anti-wear, rust inhibited lubricating oil composition comprising a mineral oil base and minor amounts of an overbased alkaline earth metal compound, a substituted trialkanolamine represented by the formula:

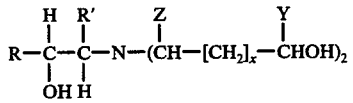

in which R is a hydrocarbyl radical having from 1 to 24 carbon atoms, R', Y and Z represent hydrogen or a hydrocarbyl radical having from 1 to 10 carbon atoms, and $x$ is 0 to 1, and a zinc dihydrocarbyl dithiophosphate represented by the formula:

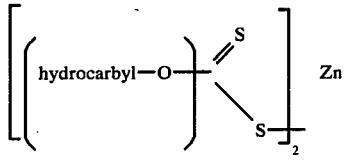

in which at least 50 percent of said hydrocarbyl radicals are alkaryl radicals having the formula:

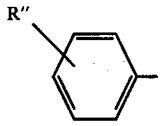

in which R'' is an alkyl radical having from about 4 to 18 carbon atoms.

A preferred aspect of the invention is a lubricant comprising a major portion of a mineral lubricating oil having an SUS viscosity at 100° F. in the range of 50 to 1000 containing from about 0.05 to 0.50 weight percent of said overbased alkaline earth metal compound, from about 0.01 to about 0.50weight percent of the prescribed substituted trialkanolamine and from about 0.025 to 0.50 weight percent of said prescribed zinc dihydrocarbyl dithiophosphate.

DETAILED DESCRIPTION OF THE INVENTION

A surprising feature of the lubricating oil composition of this invention was the discovery that certain zinc dihydrocarbyl-dithiophoshpates in a lubricant containing a substituted trialkanolamine are effective for providing a low ash, rust inhibited motor oil composition having low bearing weight losses. This discovery was made subsequent to the testing of a similar lubricating oil composition containing a different class of zinc dihydrocarbyl-dithiophosphates which was not effective for providing a lubricant which could pass the CLR L-38 Test Bearing Weight Loss specification. The effective lubricants of the present invention are critically dependent on the use of a zinc dihydrocarbyl-dithiophosphate in which at least 50 percent of the hydrocarbyl radicals are alkaryl radicals as defined herein. The prescribed composition of the invention provides a highly effective low ash, rust inhibited anti-wear lubricating oil composition which is especially efficacious as a crankcase oil for automobiles used in cold engine, short trip service.

The substituted trialkanolamine employed in lubricant of this invention is represented by the general formula:

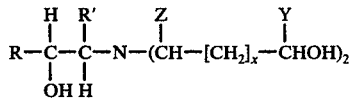

in which R is a hydrocarbyl radical having from 1 to 24 carbon atoms, R', Y and Z represent hydrogen or a hydrocarbyl radical having from 1 to 10 carbon atoms, and $x$ is 0 to 1. When R', Z and Y represent a hydrocarbyl radical, these can be the same or different aliphatic hydrocarbon radicals.

A preferred class of substituted trialkanolamines are those represented by the formula:

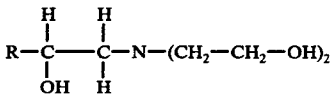

in which R has the value noted above. A more preferred substituted trialkanolamine is one in which R has from 3 to 16 carbon atoms and a still more preferred trialkanolamine is one in which R has from 8 to 14 carbon atoms. In another feature of the preferred compounds, R is a straight-chain saturated aliphatic hydrocarbon radical.

The substituted trialkanolamine employed herein is most conveniently obtained by reacting an alpha olefin epoxide compound with a dialkanolamine. This reaction is conducted by reacting approximately one mole of the alpha olefin epoxide with a mole of dialkanolamine. This invention contemplates the use of higher or lower mole ratios of the dialkanolamine in this reaction with the resultant reaction product comprising a mixture containing the principal product in combination with some other closely related products such as products derived from the reaction of an epoxide with greater than one mole of diethanolamine.

In general, the reaction proceeds in accordance with the following formula wherein the symbols have the values noted herein above.

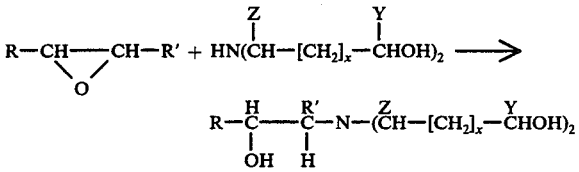

The olefin epoxide reactant which can be employed is a straight-chain aliphatic hydrocarbon having from 1 to about 24 carbon atoms. These compounds are generally characterized by having an olefin oxide functional group at one end of the chain. The compounds are typically obtained in commerce as mixtures of alpha olefin epoxides. The mixture of $C_{11}$ to $C_{14}$ alpha olefin epoxides and a mixture of $C_{15}$ to $C_{18}$ alpha olefin epoxides are typical of the reactants employed for preparing the additive and lubricant of the invention and to produce the products that are preferred species of the invention.

Examples of suitable olefin epoxide reactants are listed in Table I below:

TABLE I 1,2-epoxyoctane
2,3-epoxyoctane
4,5-epoxyoctane
1,2-epoxydodecane
1,2-epoxyhexadecane
1,2-epoxyoctadecane
3,4-epoxydecane
2,3-epoxydecane
1,2-epoxytetradecane
1,2-epoxybutane
1,2-epoxypropane
1,2-epoxyhexane
2,3-epoxypentane
2,3-epoxybutane The dialkanolamine reactant can be a single compound or a mixture of compounds within the prescribed formula including those illustrated below:

TABLE II diethanolamine
dipropanolamine
diisopropanolamine
dibutanolamine
diisobutanolamine
dipentanolamine
diisopentanolamine The reactants are brought together in a reaction vessel and gradually heated until the reaction commences which will generally be in the range of 80° to 120° C. Since the reaction is exothermic in nature, heating is discontinued when the exotherm begins. The reaction temperature increases autogenously to a range of 170°–190° C. The reaction mixture is maintained in this temperature range for about 5 to 30 minutes after which the reaction product is allowed to cool. Any compounds of the types illustrated in Table I can be reacted with those illustrated in Table II to produce the prescribed substituted trialkanolamine.

The following examples illustrate the preparation of the specific ashless substituted trialkanolamine additives employed in the present invention.

EXAMPLE I

2(2-($C_{13}$-$C_{15}$ Alkyl)), 2', 2'' - nitriloethanol 484 grams (2.0 mole) of $C_{15}$–$C_{18}$ straight-chain alpha olefin epoxide mixture and 210 grams (2.0 mole) of diethanolamine were charged to a reaction vessel. The stirred mixture was gradually heated to 100°–120° C. at which point an exothermic reaction occurred. External heating was discontinued while the heat of reaction carried the temperature of the mixture to 170°–190° C. The reaction mixture was kept within this temperature range for about 0.25–0.50 hours. The mixture was then cooled to room temperature and 685 grams of product were recovered.

EXAMPLE II

2(2-($C_9$-$C_{12}$ alkyl)), 2', 2'' - nitriloethanol 827 grams (4.25 mole) of $C_{11}$–$C_{14}$ straight-chain alpha olefin epoxide mixture and 445 grams (4.25 moles) of diethanolamine were charged to a reaction vessel and reacted and recovered as in Example I above. 1204 grams of product were realized.

EXAMPLE III

2(2-hexyl), 2', 2'' - nitriloethanol 390 grams (3.0 moles) of 1,2-epoxyoctane and 315 grams of diethanolamine (3.0 moles) were changed to a reaction vessel and reacted as described in Example I above. 705 grams of product were realized.

EXAMPLE IV

2(2-ethyl), 2', 2" - nitriloethanol 144 grams (2.0 moles) of 1,2-epoxybutane and 210 grams of diethanolamine (2.0 moles) were charged to a reaction vessel and reacted as described in Example I of above. 354 grams of product were realized.

In general, the substituted trialkanolamine is employed in the lubricating oil composition at a concentration ranging from about 0.1 to 1.5 weight percent based on said composition. A preferred concentration of this component is from about 0.01 to 0.50 weight percent. The most preferred concentration of this component is from 0.05 to 0.35 weight percent.

The prescribed zinc dihydrocarbyl-dithiophosphate is represented by the formula:

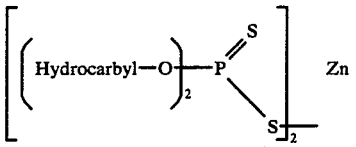

in which the hydrocarbyl radical has from 4 to 24 carbon atoms and at least 50 percent of said hydrocarbyl radicals are alkaryl radicals having the formula:

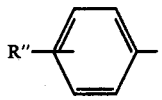

in which R" is an alkyl radical having from about 4 to 18 carbon atoms.

The preferred zinc dihydrocarbyl-dithiophosphates are those represented by formula:

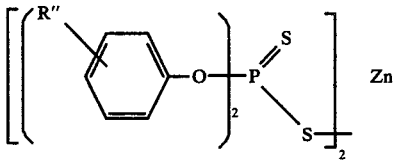

in which R" is an alkyl radical having from about 6 to 16 carbon atoms.

Examples of suitable zinc dihydrocarbyl dithiophosphates, or more specifically zinc dialkaryl dithiophosphates, within the prescribed class include:

zinc didodecylphenyldithiophosphate
zinc dinonylphenyldithiophosphate
zinc di-2-ethylhexyphenyldithiophosphate
zinc di-octadecylphenyldithiophosphate
zinc di-hexylphenyldithiophosphate
zinc di-decylphenyldithiophosphate Mixtures of the foregoing zinc dihydrocarbyl dithiophosphates with zinc dialkyldithiophosphate can also be employed in the lubricant of the invention as long as this additive component meets the critical limitation set out above, namely that at least 50 percent of the zinc dihydrocarbyl-dithiophosphates consists of zinc dialkaryl-dithiophosphates. The proportion of zinc dialkaryl-dithiophosphate in this additive component can be a greater proportion or amount over 50 percent, that is ranges of from 60, 75 or 90 to 100 percent of this component.

The method for preparing zinc dihydrocarbyldithiophosphate oil additives is well known in the art. The preparation of these additives is illustrated in U.S. Pat. Nos. 2,344,395 and 3,293,181 and their disclosures are incorporated in this application. The prescribed zinc dihydrocarbyl dithiophosphate is employed in the lubricant composition at a concentration ranging from about 0.01 to 5.00 weight percent. A preferred concentration for this additive component is from about 0.025 to 0.50 weight percent with the most preferred concentration being from about 0.05 to 0.20 weight percent.

This invention contemplates the use of the substituted trialkanolamine compound and the prescribed zinc dihydrocarbyldithiophosphate in conjunction with an overbased alkaline earth metal compound rust-inhibitor to produce a relatively low ash, anti-wear rust-inhibited lubricating oil composition. The overbased alkaline earth metal rust inhibitors are old and well known and are generally suitable in the lubricating oil composition of the invention. The preferred rust inhibitors are the overbased calcium and magnesium sulfonates and carboxylates in which the sulfonate or carboxylate portion has a molecular weight from about 300 to 600 and in which the compound has a metal ratio range greater than 1 up to about 5. The basicity of the overbased alkaline earth metal compound can also be expressed as a total base number (TBN) and typically is in the range from about 200 to 400 TBN.

Only a minor amount of the overbased alkaline earth metal compound is necessary in combination with the other prescribed additives to provide the improvement of this invention. The broad concentration range for this component is from about 0.01 to 5.0 weight percent. Good results are obtained when from 0.05 to 0.50 weight percent of the overbased alkaline earth metal compound is employed with the preferred concentration being from about 0.10 to 0.30 weight percent. A particularly effective lubricant is a balanced composition comprising the prescribed substituted trialkanolamine and zinc dihydrocarbyl dithiophosphate additives in conjunction with a basic alkaline earth metal salt of sulfonic acid or a carboxylic acid as described in U.S. Pat. No. 3,537,996; 3,242,080; 3,242,079; 2,839,470 and 3,282,935. The disclosures of these patents are incorporated into the present application.

It is understood that a concentrate of the hydrocarbyl-substituted trialkanolamine, the zinc dihydrocarbyldithiophosphate and of the overbased alkaline earth metal compound can be prepared in a suitable vehicle, such as a mineral oil, which can be employed in the preparation of the lubricating oil composition of the invention. Such a concentrate may contain from 1 to 50 weight percent of any combination of the additive components for the lubricating oil composition of this invention.

The base oil for the lubricant of the invention can be predominantly paraffinic or naphthenic or it can be a mixture of both types of mineral oils. In general, the base oil will be a relatively highly refined mineral oil of predominantly paraffinic nature and will have a viscosity in the range of about 50 to 1000 Saybolt Universal Seconds at 100° F and preferably from about 100 to 700 SUS.

The bearing weight loss was determined in the CLR L-38 Oxidation-Bearing Corrosion Test, Federal Test Method STD. No. 791a, Method 3405. According to this test, the lubricant being tested is employed in a single cylinder Labeco CLR Oil Test Engine equipped with copper-lead connecting rod bearings of known weight. The engine is run for 40 hours at 3150 ± 25 RPM. The copper-lead bearings are weighed a second time at the end of the test and the bearing weight loss determined.

The base oils employed for preparing the lubricant of the invention were essentially paraffinic base mineral oils. Base Oil A had an SUS viscosity at 210° F of about 41.5 and Base Oil B had an SUS viscosity at 210° F. of about 54. The base oils are used singly or in blends to produce the mineral oil substrate for the lubricant of the invention. The mineral oil substrate is the major component of the lubricant composition. In general, the oil base comprises from about 85 to 95 weight percent of the lubricating oil composition.

A Base Blend was prepared from the above base oils containing minor amounts of conventional lubricating oil additives to provide viscosity index improvement, antioxidant, dispersant and anti-foaming properties. This Base Blend has no material effect on bearing weight loss as measured in the L-38 Oxidation-Bearing Corrosion Test. The SE limits for bearing weight loss is a maximum of 40 milligrams. This Base Blend was combined with the essential additive components of the invention as set forth in Table III below.

The low-ash, rust inhibited, anti-wear lubricating oil composition of the invention and comparison oil were tested for bearing weight loss in the L-38 Test and the results are set forth in the Table below.

TABLE III

| Lubricating Oil Composition, Wt % | A | B | C | |
|---|---|---|---|---|
| Calcium Carbonate Overbased calcium sulfonate, 300 TBN, (%Ca) | 0.16 | 0.16 | 0.16 | |
| Substituted trialkanolamine, Ex. I | — | — | 0.25 | |
| Substituted trialkanolamine, Ex. II | 0.25 | 0.25 | — | |
| Zinc di-$C_7$-$C_9$-alkyldithiophosphate, (%Zn) | 0.07 | 0.05 | — | |
| Zinc di-dodecylphenyldithiophosphate, (%Zn) | 0.03 | 0.05 | 0.10 | |
| Base Blend | 99.49 | 99.49 | 99.49 | Limit |
| L-38 Bearing Weight Loss, Mgs. | 97.7 | 17.9 | 24.9 | 40 Max. |

Lubricating Oil Composition A described above, which contained a mixture of zinc dithiophosphate compounds but less than 50 percent of a zinc dialkaryldithiophosphate, failed the L-38 Bearing Weight Loss Test with a weight l ss of 97.7 milligrams.

In contrast, Lubricating Oil Compositions B and C both passed the L-38 Bearing Weight Loss Test by wide margins as shown by the bearing weight losses of 17.9 and 24.9 milligrams respectively. These surprising results demonstrate criticality in the composition of an effective lubricant according to the present invention, namely that the zinc dihydrocarbyldithiophosphate must consist of at least 50 weight percent of a zinc dialkaryldithiophosphate.

A lubricating oil composition comparable to those described in Table III above but containing 0.10 weight percent of zinc derived from zinc di-$C_7$-$C_9$ alkyldithiophosphate and no zinc di-alkaryldithiophosphate also failed the L-38 Bearing Weight Loss Test with a weight loss of 275 milligrams.

An effective lubricating oil composition is prepared by substituting zinc di-nonylphenyldithiophosphate for zinc di-dodecylphenyldithiophosphate in Lubricating Oil Composition C in Table III above.

Another effective lubricating oil composition is prepared by substituting zinc di-hexylphenyldithiophosphate for zinc di-dodecylphenyldithiophosphate in Lubricating Oil Composition C in Table III above.

In summary, there is provided a surprisingly effective low-ash lubricating oil composition which exhibits low bearing weight losses when employed as a crankcase oil for an internal combustion engine.

We claim:

1. A low-ash lubricating oil composition comprising 85 to 95 weight percent of a mineral lubricating oil, 0.05 to 0.50 weight percent of an overbased alkaline earth metal sulfonate or carboxylate, 0.01 to 0.50 weight percent of a substituted trialkanolamine represented by the formula:

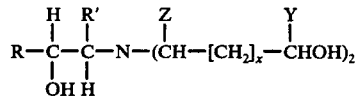

in which R is a hydrocarbyl radical having from 3 to 16 carbon atoms, R', Z and Y represent hydrogen or a hydrocarbyl radical having from 1 to 10 carbon atoms, and x is 0 or 1, and 0.025 to 0.50 weight percent of a zinc dihydrocarbyldithiophosphate represented by the formula:

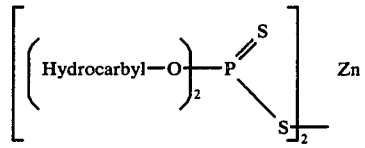

in which the hydrocarbyl radical has from 4 to 24 carbon atoms and at least 50 percent of said hydrocarbyl radicals are alkaryl radicals having the formula:

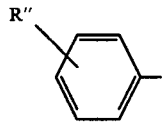

in which R'' is an alkyl radical having from about 4 to 18 carbon atoms.

2. A low-ash lubricating oil composition comprising 85 to 95 weight percent of a mineral lubricating oil, 0.05 to 0.50 weight percent of an overbased alkaline earth metal sulfonate or carboxylate, 0.01 to 0.50 weight percent of a substituted trialkanolamine represented by the formula:

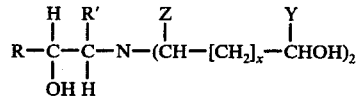

in which R is a hydrocarbyl radical having from 8 to 14 carbon atoms, R', Z and Y represent hydrogen or a hydrocarbyl radical having from 1 to 10 carbon atoms, and x is 0 or 1, and 0.025 to 0.50 weight percent of a zinc dihydrocarbyldithiophosphate represented by the formula:

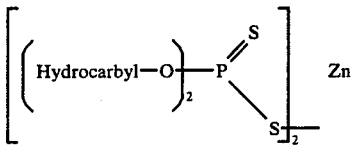
in which the hydrocarbyl radical has from 4 to 24 carbon atoms and at least 50 percent of said hydrocarbyl radicals are alkaryl radicals having the formula:
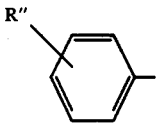
in which R'' is an alkyl radical having from about 4 to 18 carbon atoms.
* * * * *